United States Patent [19]

Fleury

[11] 4,243,915

[45] Jan. 6, 1981

[54] DELAY LINE COMPRISING COUPLED CAVITIES AND COOLED BY FLUID-CIRCULATION

[75] Inventor: Georges Fleury, Paris, France

[73] Assignee: Thomson-CSF, Paris, France

[21] Appl. No.: 33,056

[22] Filed: Apr. 25, 1979

[30] Foreign Application Priority Data

May 2, 1978 [FR] France ..... 78 12903

[51] Int. Cl.[3] ..... H01J 25/34

[52] U.S. Cl. ..... 315/3.5; 313/30; 313/36; 315/3.6; 315/39.3

[58] Field of Search ..... 315/3.5, 3.6, 39.3; 313/30, 36, 45, 17, 22

[56] References Cited

U.S. PATENT DOCUMENTS

| | | | |
|---|---|---|---|
| 2,993,143 | 7/1961 | Kelliher | 315/36 X |
| 3,412,279 | 11/1968 | Allen et al. | 315/3.5 |
| 3,449,618 | 6/1969 | Gallagher | 315/3.5 |
| 3,866,085 | 2/1975 | James | 315/3.5 |

*Primary Examiner*—Saxfield Chatmon, Jr.
*Attorney, Agent, or Firm*—Roland Plottel

[57] ABSTRACT

The external outline of the transverse section of the walls externally bounding the cavities (4) is circular, but the thickness of these walls is not constant, being smaller in the zones of these walls which are not traversed by the cooling ducts (5) than in the other zones. Application to travelling-wave tubes carried in aircraft.

3 Claims, 4 Drawing Figures

DELAY LINE COMPRISING COUPLED CAVITIES AND COOLED BY FLUID-CIRCULATION

The present invention relates to travelling-wave tubes. It concerns more particularly a delay line comprising coupled cavities which is used in a travelling-wave tube and is cooled by fluid-circulation.

As is known, the delay line associated with a travelling-wave tube provides interaction between a beam of electrons moving on the axis of the line and an electromagnetic wave passing through the line; when the conditions of synchronism are attained between the wave and the beam, the electrons give up energy to the electromagnetic wave.

As regards the delay line, lines comprising coupled cavities are widely used. They generally comprise discs aligned parallel to one another along one and the same axis constituting the axis of the line, and forming the wall common to two adjacent cavities. These discs comprise a central aperture for the electron beam to pass through, and at least one inter-cavity coupling aperture. The cavities are externally bounded by cylindrical walls. The device for focussing the electron beam on the axis of the line surrounds these walls: it may take the form of an electromagnet, but more generally comprises an alternating succession, on the axis of the line, of permanent-magnet washers covering the cylindrical walls which externally bound the cavities, the faces of identical denomination of these magnets being disposed towards one another, and washers of magnetic material in the form of extensions of the discs constituting the walls common to two cavities.

When the mean power of travelling-wave tubes becomes high of the order of 1 to 2 KW at 10 GHz, the delay line must be fluid-cooled, since considerable high-frequency losses occur in it, and in addition the dispersion inherent to the electron beam causes additional heating.

The cylindrical walls which externally bound the cavities are then traversed by ducts in which the coolant fluid circulates, and their thickness must be increased.

The disadvantage of delay lines comprising coupled cavities and cooled by fluid-circulation known from prior art is that of increasing the thickness of the cylindrical walls externally bounding the cavities with respect to lines not cooled by fluid-circulation, such increase not being negligible and therefore increasing the bulk of the delay line.

The increase in thickness of the cylindrical walls externally bounding the cavities is particularly troublesome when the electron beam is focussed by permanent magnets, since this method of focussing exhibits great advantages in weight, electricity consumption and reduction of leaks from magnetic fields in particular.

In fact, when focussing is carried out by permanent magnets the increase in thickness of the cylindrical walls externally bounding the cavities involves an increase in the internal diameter of the permanent-magnet washers. In order to obtain the same magnetic focussing field, the external diameter of the magnetic washers must be greatly increased, their thickness being kept constant for reasons of magnetic pitch.

In this case, fluid-cooling involves a large increase in the bulk and weight of the delay line and an increment in the demagnetising field in which the magnets work, which means that they have to be made of materials having a particularly strong coercive field, such as samarium-cobalt; the manufacturing cost of the delay line is likewise increased.

The invention concerns a delay line comprising coupled cavities and cooled by fluid-circulation whereof the external diameter of the walls externally bounding the cavities is less than that of a line of this type according to prior art exhibiting identical electrical characteristics. The invention therefore enables a less bulky line to be embodied. This advantage is considerable since lines of this type are frequently used in aircraft equipment.

When focussing by permanent magnets is used, the line according to the invention allows to use classical permanent magnets taking the form of washers and having reduced external and internal diameters. The line according to the invention likewise exhibits advantages in lightness and cost.

The delay line comprising a coupled cavities and cooled by fluid-circulation according to the invention consists of:

discs aligned parallel to one another along one and the same axis constituting the axis of the line, these discs forming the wall common to two adjacent cavities and comprising a central aperture for the electron beam, focussed on the axis of the line, to pass through, and at least one inter-cavity coupling aperture;

walls externally bounding the cavities, the external outline of the transverse section of these walls being circular, these walls being traversed by ducts in which the cooling fluid circulates and having a thickness smaller in the zones which are not traversed by the cooling ducts than in the other zones.

Other subjects, features and results of the invention will appear from the following description which is given by way of non-limitative example and illustrated by the appended Figures, wherein:

In the various figures, the same references designate the same elements, and for the sake of clarity none of the hidden angles of intersection is illustrated.

FIGS. 1 and 2 illustrate transverse and longitudinal sections of a delay line comprising coupled cavities according to prior art. The delay line illustrated is focussed by permanent magnets.

Figure 1:
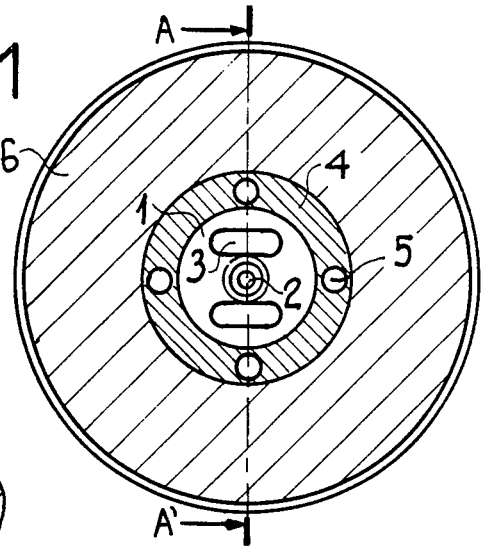
FIG 1 PRIOR ART
FIGS. 1 and 2 show transverse and longitudinal sections of a delay line comprising coupled cavities and cooled by fluid-circulation according to prior art.
Figure 2:
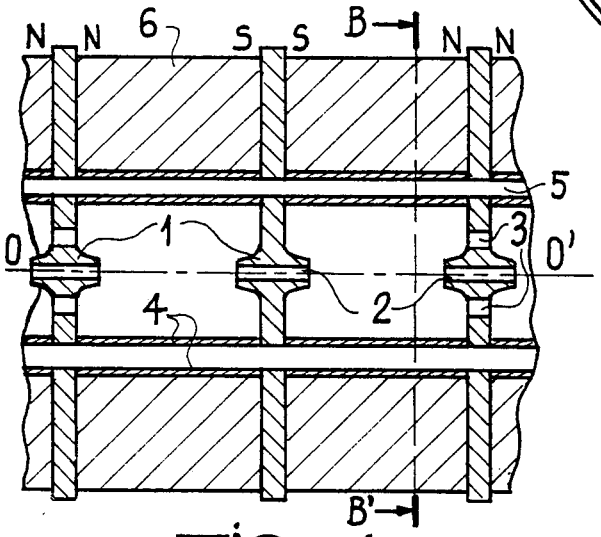
PRIOR ART FIG 2

Let 1 be the discs constituting the wall common to two adjacent cavities. These discs are made of magnetic material, soft iron for example, and are perforated with a central aperture 2, round which their thickness is greatly increased, and two inter-cavity coupling apertures 3.

The cylindrical walls 4 which externally bound the cavities are made of non-magnetic material, copper for example. The walls 4 are traversed by ducts 5 in which there circulates the cooling fluid, which is generally a liquid.

The electron beam is focussed on the axis OO′ of the line by an alternating succession of permanent-magnet washers in extension of the discs 1.

Figure 3:
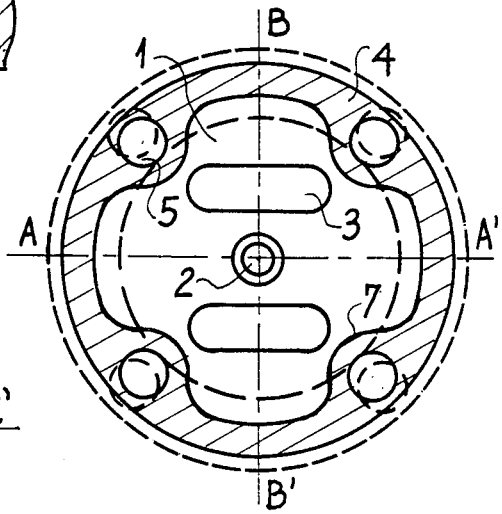
FIGS. 3 and 4 show transverse sections of two forms of embodiment of a delay line comprising coupled cavities and cooled by fluid-circulation according to the invention.
Figure 4:
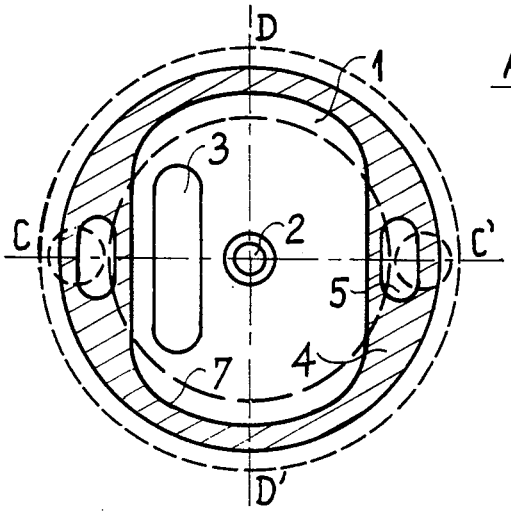

FIGS. 3 and 4 illustrate by way of example the transverse sections of two forms of embodiment of a delay line comprising coupled cavities and cooled by fluid-circulation according to the invention.

In these figures, lines of prior art having electrical characteristics identical with those of lines according to the invention are illustrated in broken line, and lines according to the invention are illustrated in full line; the focussing devices of the various lines embracing the externally cylindrical walls which externally bound the cavities are not illustrated.

FIG. 3 illustrates a line focussed by permanent magnets whereof the discs 1 have, as is generally the case in this method of focussing, two inter-cavity coupling apertures 3 which are symmetrical with respect to two perpendicular axis AA' and BB' intersecting on the axis of the line, one of these axis coinciding with one axis of symmetry of the apertures 3.

The external outline of the transverse section of the walls 4 externally bounding the cavities is circular. The thickness of these walls is not constant. It is smaller in the zones of the walls which are not traversed by the cooling ducts 5 (in these zones the volume of the cavities is therefore increased) than in the other zones.

The reduction in thickness of the walls 4 externally bounding the cavities in the zones through which the cooling ducts 5 do not pass enables the external diameter of these walls, and therefore the internal diameter of the magnetic washers 6, to be reduced by about 10% while maintaining the electrical characteristics of the cavities, the shunt impedance (R/Q) and the overvoltage coefficient (Q) in particular, practically unchanged. The invention enables a still more important gain to be achieved, of about 15%, on the external diameter of the magnetic washers, and of about 20%, on their mass.

On the line illustrated in FIG. 3, four cooling ducts 5 are disposed at an inclination of 45° with respect to the axis AA' and BB' and symmetrically with respect to these axis. The internal outline 7 of the transverse section of the walls 4 externally bounding the cavities is substantially cruciform, and identical in each half-plane defined by the axis AA' and BB'.

The line illustrated in FIG. 3 therefore enables the apertures 3 for coupling one cell to another to be alternated by 90°, as is generally done when interaction between the beam and the electromagnetic wave occurs at the first harmonic of the wave.

FIG. 4 illustrates another form of embodiment of a line according to the invention.

The discs 1 of this line have a single inter-cavity coupling aperture 3. Two cooling ducts 5 are disposed symmetrically with respect to two axis CC' and DD', which intersect on the axis OO' of the line, the axis CC' coinciding with one axis of symmetry of the ducts 5 and of the coupling aperture 3.

The internal outline 7 of the transverse section of the walls 4 externally bounding the cavities is substantially elliptical, the major axis of the ellipse being parallel to the axis DD'; this outline 7 is identical in each half-plane defined by the axis DD'. the coupling apertures 3 to be alternated by 180° from one cell to another, as is generally done.

The internal outline 7 of the walls which externally bound the cavities may be made by cutting out, drifting or pressing.

What we claim is:

1. A delay line comprising coupled cavities and cooled by fluid-circulation, said cavities being substantially defined by discs (1) and walls (4), which consists of:

said discs (1) being aligned parallel to one and the same axis (O—O') constituting the axis of the line, these discs (1) forming the wall common to two adjacent cavities and comprising a central aperture (2) for the electron beam, focussed on the axis of the line, to pass through, and having at least one inter-cavity coupling aperture (3);

said walls (4) longitudinally bounding the cavities, the external shape of a transverse section of these walls being circular, these walls being traversed by ducts (5) in which a cooling fluid circulates; and the direct distance from the axis (O—O') to the internal side of said walls being shorter in those regions of the walls having ducts, than to those regions not having the ducts.

2. A delay line according to claim 1, wherein the discs (1) forming the wall common to two adjacent cavities have two inter-cavity coupling apertures (3, in FIG. 3) symmetrical with respect to two perpendicular axis (A—A', B—B') which intersect on the axis of the line, O—O', one of these axis (B—B') coinciding with one axis of symmetry of the apertures and four cooling ducts (5) being disposed at an inclination of 45° with respect to these two axis and symmetrically with respect thereto, and wherein the internal shape of the transverse section of the walls, is substantially cruciform and identical in each half-plane defined by the two axis.

3. A delay line according to claim 1, wherein the discs forming the wall common to two adjacent cavities have one inter-cavity coupling aperture, two cooling ducts being disposed symmetrically with respect to two perpendicular axis which intersect on the axis of the line, a first axis coinciding with one axis of symmetry of the ducts and of the coupling aperture and wherein the internal shape of the transverse section of the walls externally bounding the cavities is substantially elliptical, the major axis of the ellipse being parallel to the second axis.

* * * * *